US005897240A

United States Patent [19]

Yoo

[11] Patent Number: 5,897,240

[45] Date of Patent: Apr. 27, 1999

[54] CONCENTRATION MEASURING DEVICE OF ELECTROGRAPHIC PRINTER

[75] Inventor: Yong-baek Yoo, Suwon, Rep. of Korea

[73] Assignee: Samsung Electronics Co., Ltd., Kyungki-do, Rep. of Korea

[21] Appl. No.: 09/094,553

[22] Filed: Jun. 15, 1998

[30] Foreign Application Priority Data

Mar. 6, 1998 [KR] Rep. of Korea ..... 98-7514

[51] Int. Cl.[6] ..... G03G 15/10

[52] U.S. Cl. ..... 399/58; 399/30; 399/57; 118/691

[58] Field of Search ..... 399/57, 58, 64, 399/65, 30, 62; 356/72, 441, 442; 118/689, 691

[56] References Cited

U.S. PATENT DOCUMENTS

| | | | |
|---|---|---|---|
| 4,266,141 | 5/1981 | Hirakura et al. | 399/65 |
| 4,447,145 | 5/1984 | Snelling et al. | 399/65 |
| 4,671,309 | 6/1987 | Iemura et al. | 399/57 |
| 5,319,421 | 6/1994 | West | 399/59 |
| 5,598,251 | 1/1997 | Parish et al. | 399/30 |
| 5,649,264 | 7/1997 | Domon et al. | 399/30 |
| 5,682,574 | 10/1997 | Oshida et al. | 399/64 |

FOREIGN PATENT DOCUMENTS

| | | |
|---|---|---|
| 62-088942 | 4/1987 | Japan . |
| 5-133892 | 5/1993 | Japan . |
| 6-066723 | 3/1994 | Japan . |

*Primary Examiner*—Matthew S. Smith
*Attorney, Agent, or Firm*—Sughrue, Mion, Zinn, Macpeak & Seas, PLLC

[57] ABSTRACT

A concentration measuring device, in an electrographic printer, for measuring the concentration of developer liquid supplied from a mixing container to a development device. The concentration measuring device includes a variable thickness body installed between the mixing container and the development device for changing the thickness of a developer liquid passage for light to transmit; a light emitting device installed a predetermined distance from one side of the variable thickness body for emitting light; and a light detector installed a predetermined distance from the other side of the variable thickness body for detecting the light from the light emitting device and measuring the concentration of developer liquid according to the amount of received light.

7 Claims, 4 Drawing Sheets

CONCENTRATION MEASURING DEVICE OF ELECTROGRAPHIC PRINTER

BACKGROUND OF THE INVENTION

1. Field of the Invention

The present invention relates to a concentration measuring device for measuring the concentration of a developer liquid in an electrographic printer.

2. Description of the Related Art

FIG. 1 shows a schematic diagram illustrating a conventional electrographic printer.

Referring to FIG. 1, an electrographic printer includes: a photosensitive belt 14 which is supported by a driving roller 11, a steering roller 12 and a backup roller 13, and circulates in a closed loop; four development devices 17*a* through 17*d*; and a transfer roller 25 which rotates in contact with the backup roller 13. The surface of the photosensitive belt 14 is charged by a corona charger. Laser scanning units 18*a* through 18*d* are installed in the vicinity of the respective development devices 17*a* through 17*d*, and the laser beams from the laser scanning units 18*a* through 18*d* scan the surface of the photosensitive belt 14, and change the potential of the surface of the photosensitive belt 14 to form an electrostatic latent image. The photosensitive belt 14 formed with the electrostatic latent image is sequentially developed by the development devices 17*a* through 17*d* containing respective developer liquids of black, yellow, cyan and magenta colors, and accordingly a color image is formed on the photosensitive belt 14. In this case, a cleaning roller 23 removes a carrier from the color image formed on the photosensitive belt 14, and heating rollers 24 evaporate the carrier on the surface of the cleaning roller 23.

The developed color image on the photosensitive belt 14 is transferred to the transfer roller 25, and the color image transferred to the transfer roller 25 is transferred to a paper 27 by the difference of the surface energies. The color image transferred to the paper 27 is firmly fixed to the paper 27 by a fixing roller 26. Once printing is completed in this manner, an eraser 15 completely removes the charge on the photosensitive belt 14, and prepares the photosensitive belt 14 to form a new electrostatic latent image.

The developer liquids contained in the development devices 17*a* through 17*d* are mixtures of respective toners and a carrier, the toners are stored in toner containers 19*a* through 19*d* and are supplied to mixing containers 21*a* through 21*d* by pumps 20*a* through 20*d*, and the carrier is stored in a carrier container 28 and is supplied to the mixing containers 21*a* through 21*d*. The toners and the carrier supplied to the mixing containers 21*a* through 21*d* are mixed to have an appropriate concentration, and are supplied to the development devices 17*a* through 17*d* by pumps 22*a* through 22*d*, respectively.

In the printer as described above, the concentrations of the developer liquids supplied to the respective development devices 17*a* through 17*d* must be maintained to be constant, and therefore the mixing ratios of the toners and the carrier which are supplied from the toner containers 19*a* through 19*d* and the carrier container 28 are maintained within an appropriate range.

In order to decide whether the mixing ratio of the toner and the carrier is appropriate, the concentration of the developer liquid must be measured. However, since an appropriate device capable of measuring the concentration of the developer liquid is not provided in a conventional printer, it is impossible to know whether the developer liquid is at an appropriate concentration. Therefore, the tones of a color image are abnormal when the concentrations of the developer liquids are irregular.

SUMMARY OF THE INVENTION

To solve the above problem, it is an object of the present invention to provide a concentration measuring device for measuring the concentration of a developer liquid in an electrographic printer.

Accordingly, to achieve the above object, there is provided a concentration measuring device for measuring the concentration of developer liquid supplied from a mixing container to a development device in an electrographic printer. The concentration measuring device includes a variable thickness body installed between the mixing container and the development device for changing the thickness of a developer liquid passage for light to transmit; a light emitting device installed a predetermined distance from one side of the variable thickness body for emitting light; and a light detector installed a predetermined distance from the other side of the variable thickness body for detecting the light from the light emitting device and measuring the concentration of the developer liquid according to the amount of received light.

The variable thickness body includes: a pair of transparent substrates made of transparent material for forming a passage of the developer liquid therebetween; a spacing bar installed between first side edges of the transparent substrates for maintaining a space between the transparent substrates; a driver installed at the other side of the transparent substrate for changing the thickness of the developer liquid passage by changing the distance between second side edges of the transparent substrates; and a pair of sealing members installed at both the first and the second side edges of the transparent substrates for preventing the developer liquid contained between the transparent substrates from leaking.

In addition, another variable thickness body includes: a pair of transparent substrates made of transparent material for forming a passage of the developer liquid therebetween; a pair of sealing members installed at both edges of the transparent substrates for preventing the developer liquid contained between the transparent substrates from leaking; and a driver installed with respect to at least one of the transparent substrates for changing the thickness of the developer liquid passage by changing the distance between the transparent substrates.

BRIEF DESCRIPTION OF THE DRAWINGS

The above object and advantages of the present invention will become more apparent by describing in detail preferred embodiments thereof with reference to the accompanying drawings, in which.

DETAILED DESCRIPTION OF THE PREFERRED EMBODIMENTS

Figure 1:
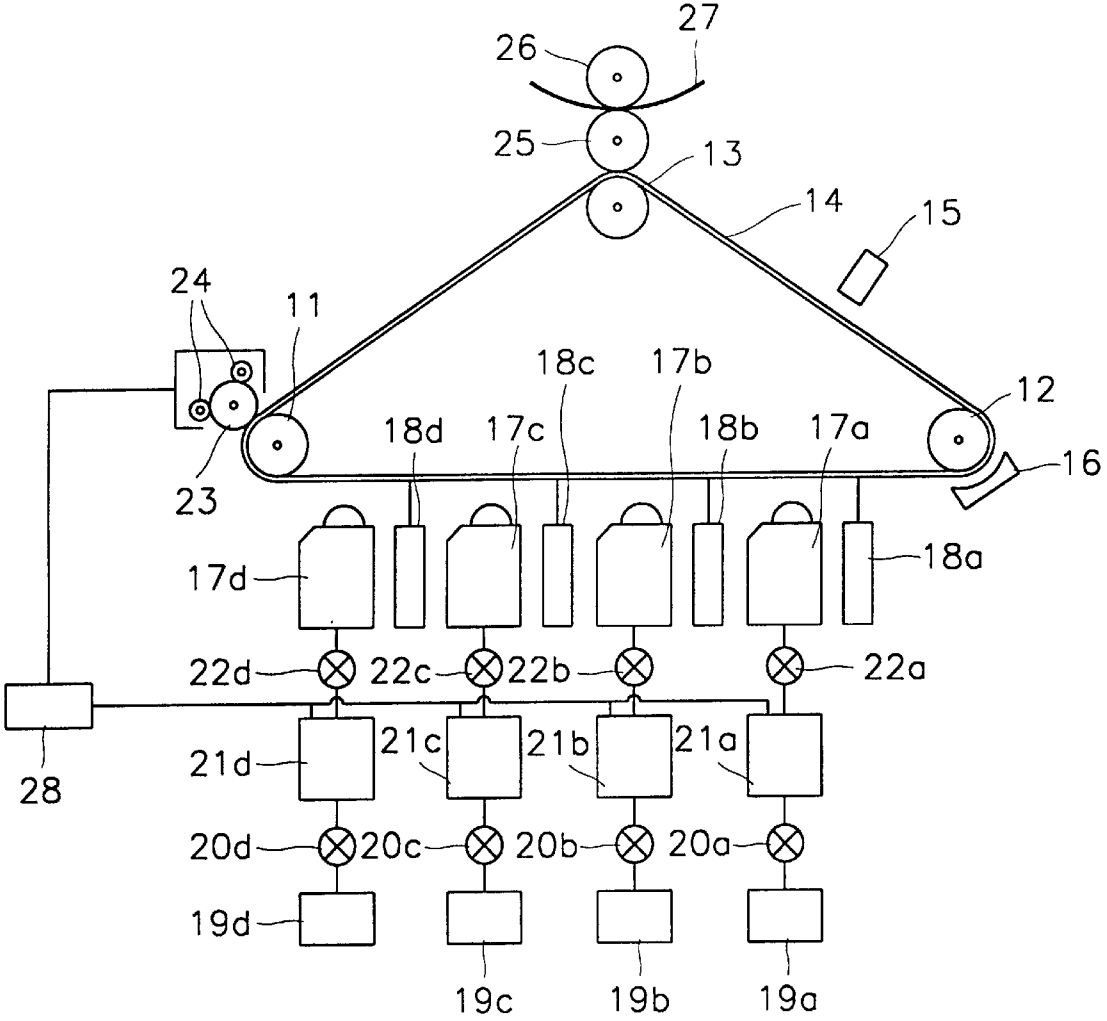
FIG. 1(PRIOR ART)
FIG. 1 is a schematic diagram illustrating a conventional electrographic printer.

Preferred embodiments of a concentration measuring device according to the present invention are described in detail with reference to the attached drawings. In this case, the same reference numerals as those of FIG. 1 denote similar members having similar functions.

Figure 2:
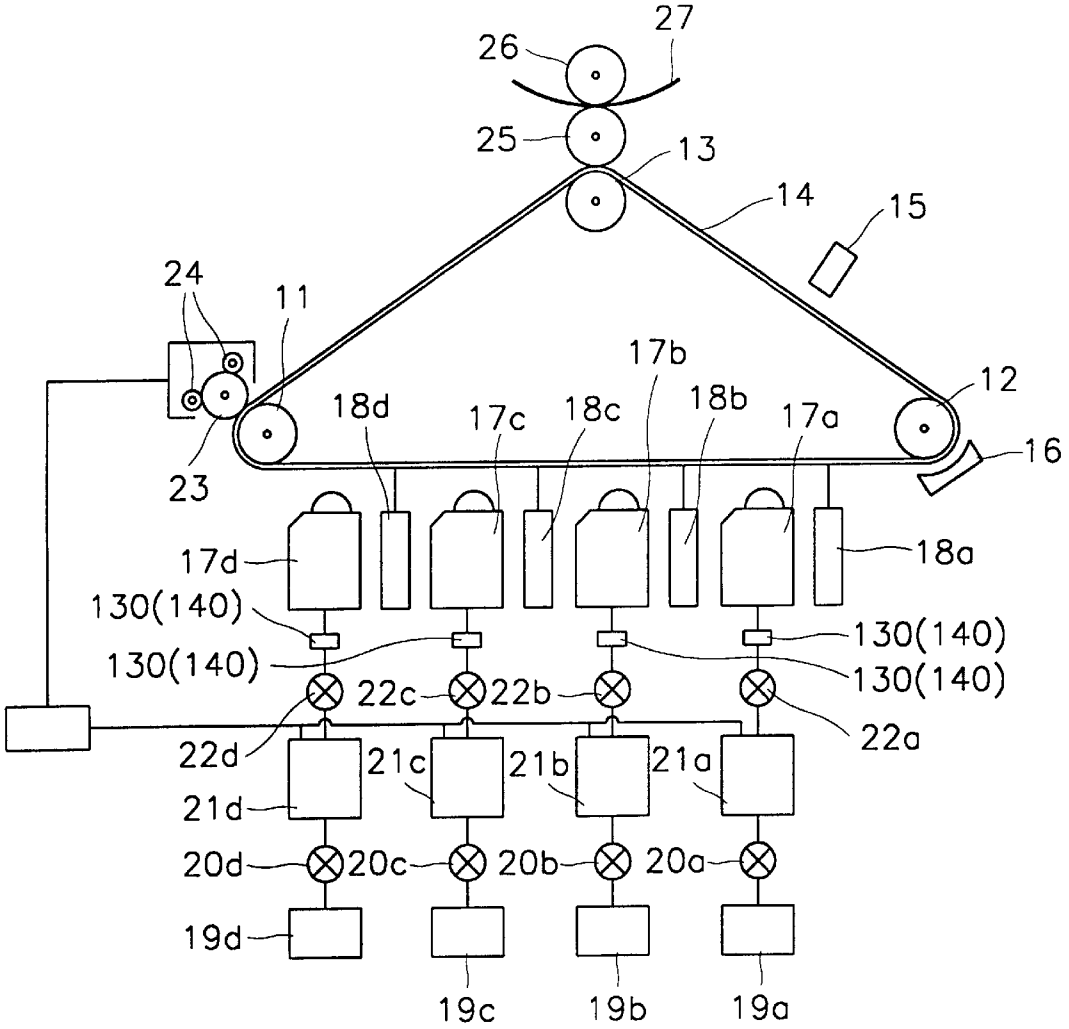
FIG. 2 is a schematic diagram illustrating an electrographic printer employing a concentration measuring device according to the present invention.

FIG. 2 shows the schematic structure of an electrographic printer employing a first embodiment of a concentration measuring device according to the present invention. Four concentration measuring devices 130 are installed between mixing containers 21*a* through 21*d* and development devices 17*a* through 17*d*, respectively. Since the other components are the same as those of FIG. 1, a detailed description thereof will be omitted.

Figure 3:
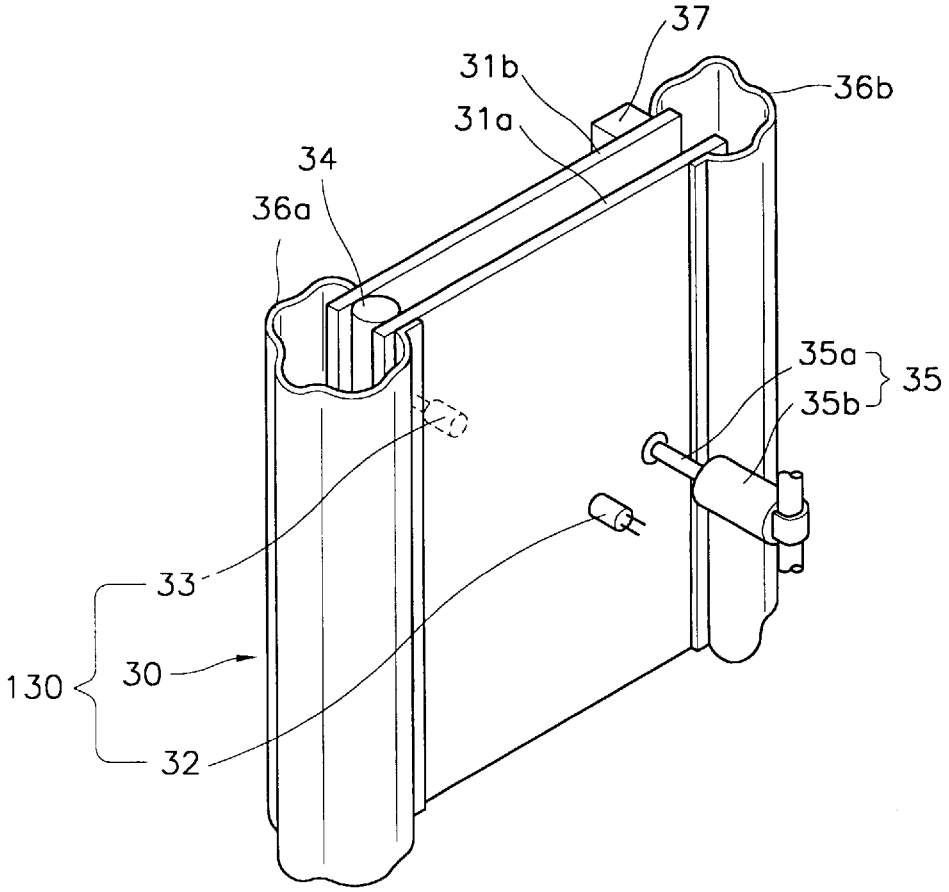
FIG. 3 is a perspective view illustrating a first embodiment of the concentration measuring device employed in the printer of FIG. 2.
Figure 4:
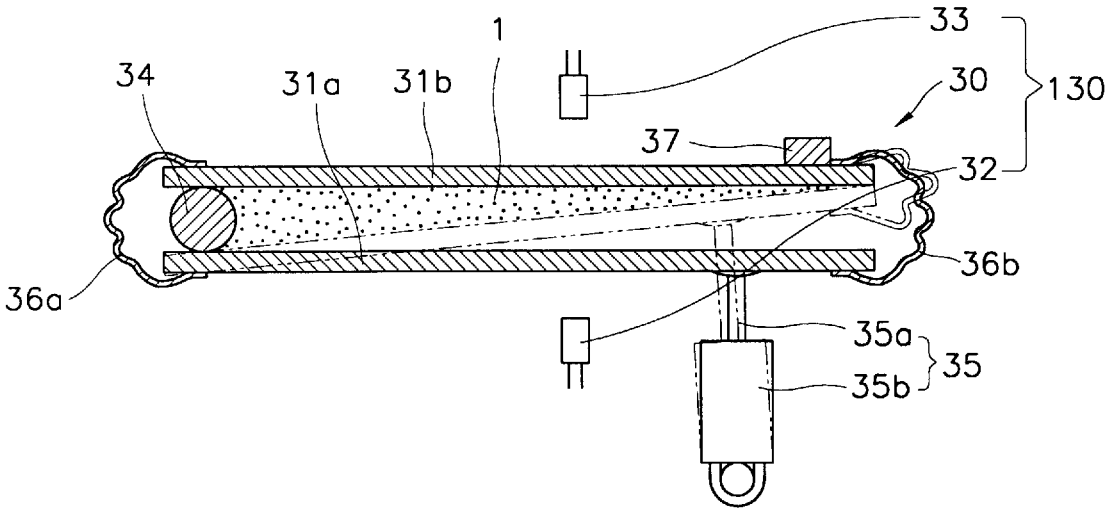
FIG. 4 is a sectional view illustrating the concentration measuring device shown in FIG. 3.

FIGS. 3 and 4 show the structure of a first embodiment of a concentration measuring device according to the present invention. As shown in FIGS. 3 and 4, each of the concentration measuring devices 130 includes a variable thickness body 30 installed between one of the mixing containers 21*a* through 21*d* and a corresponding one of the development devices 17*a* through 17*d* for changing the thickness of a developer liquid passage for light to transmit, a light emitting device 32 for emitting light installed a predetermined distance from one side of the variable thickness body 30, and a light detector 33 installed a predetermined distance from the other side of the variable thickness body 30 for detecting the light from the light emitting device 32 and measuring the concentration of the developer liquid 1 according to the amount of received light. It is preferable that the light emitting device 32 is an LED (light emitting device) and the light detector 33 is a photodiode or a phototransistor.

The variable thickness body 30 is provided with a pair of transparent substrates 31*a* and 31*b* made of transparent material for forming a passage of the developer liquid 1 therebetween, a spacing bar 34 installed between first side edges of the transparent substrates 31*a* and 31*b* for maintaining a space between the transparent substrates 31*a* and 31*b*, a driver 35 installed at the other side of the transparent substrate 31*a* for changing the thickness of the developer liquid passage by changing the distance between second side edges of the transparent substrates 31*a* and 31*b*, and a pair of sealing members 36*a* and 36*b* installed at both the first and second side edges of the transparent substrates 31*a* and 31*b* for preventing the developer liquid 1 contained between the transparent substrates 31*a* and 31*b* from leaking. In addition, a supporting member 37 is installed at one side of the transparent substrate 31*b* by the side of the sealing member 36*b* to fix the transparent substrate 31*b*. The supporting member 37 is fixed at a predetermined position in the printer.

The driver 35 is composed of a rod 35*a* installed on the transparent substrate 31*a*, and a solenoid 35*b* for pushing and pulling the rod 35*a*. In this embodiment, though the driver 35 is installed on one transparent substrate 31*a*, another driver may be installed on the other transparent substrate 31*b*. It is preferable that the sealing members 36*a* and 36*b* are in the shape of a bellows having pleats to allow expansion and contraction.

Now, the operation of the concentration measuring device as described above will be described.

During normal operation of a printer, the developer liquids of the mixing containers 21*a* through 21*d* are supplied to the respective development devices 17*a* through 17*d* via the respective variable thickness bodies 30. In this state, the transparent substrates 31*a* and 31*b* are parallel to each other to form a normal passage, and the developer liquid passes freely through the passage.

When the concentration of the developer liquid 1 is to be measured, the thickness of the variable thickness body 30 must be reduced to make the thickness of the developer liquid 1 thin. The reason is that the light from the light emitting device 32 cannot travel to the light detector 33 when the thickness of the developer liquid is thick.

In order to make the thickness of the variable thickness body 30 thin, the rod 35*a* of the driver 35 pushes the edge of the transparent substrate 31*a* toward the other transparent substrate 31*b* to make the edges of the two transparent substrates 31*a* and 31*b* contact each other. At this time, the section of the variable thickness body 30 becomes triangular, and while light can transmit through the thinner portion easily, light cannot transmit through the thicker portion. Since the light emitting device 32 and the light detector 33 are arranged at a relatively thin portion, the light emitted from the light emitting device 32 can transmit the developer liquid 1. The sealing members 36*a* and 36*b* seal the edges of the transparent substrates 31*a* and 31*b*, and prevent the developer liquid 1 contained in the transparent substrates 31*a* and 31*b* from leaking. At this stage, the light emitting device 32 emits light toward the developer liquid 1, and the light detector 33 detects the light transmitted through the developer liquid 1, and the concentration of the developer liquid is decided by measuring the amount of transmitted light.

Figure 5:
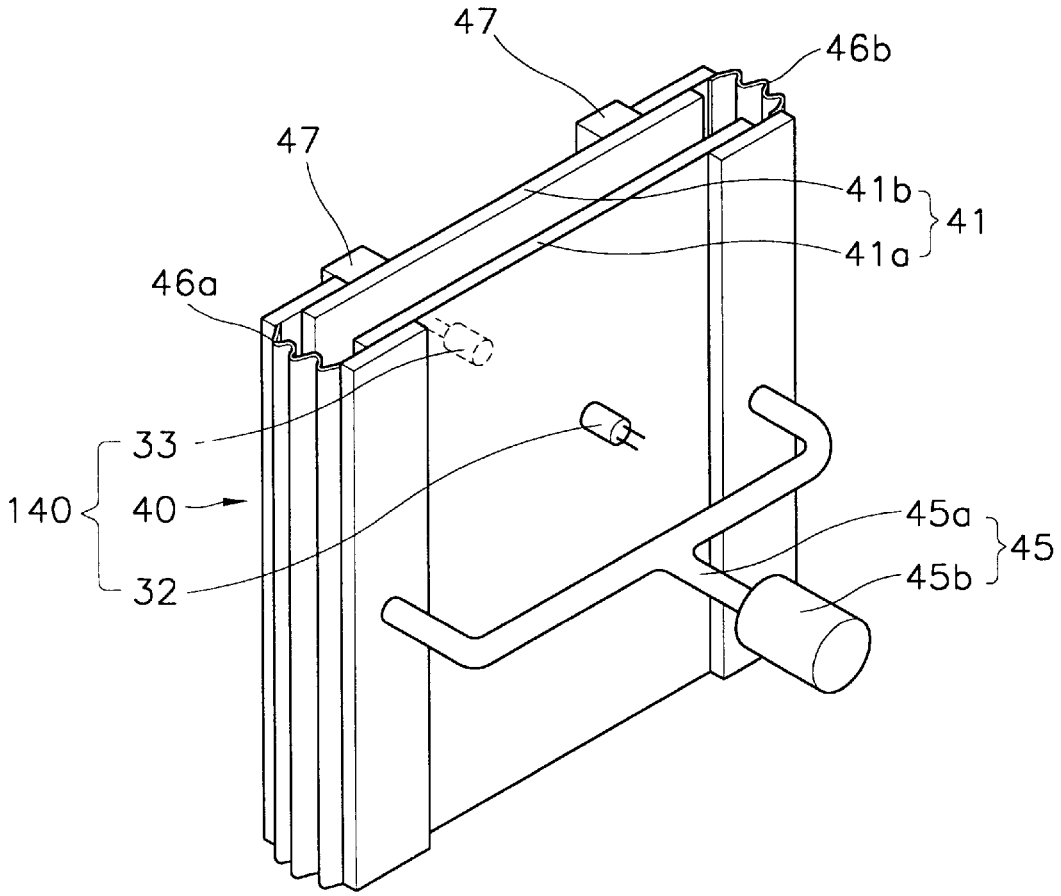
FIG. 5 is a perspective view illustrating a second embodiment of the concentration measuring device employed in the printer of FIG. 2.
Figure 6:
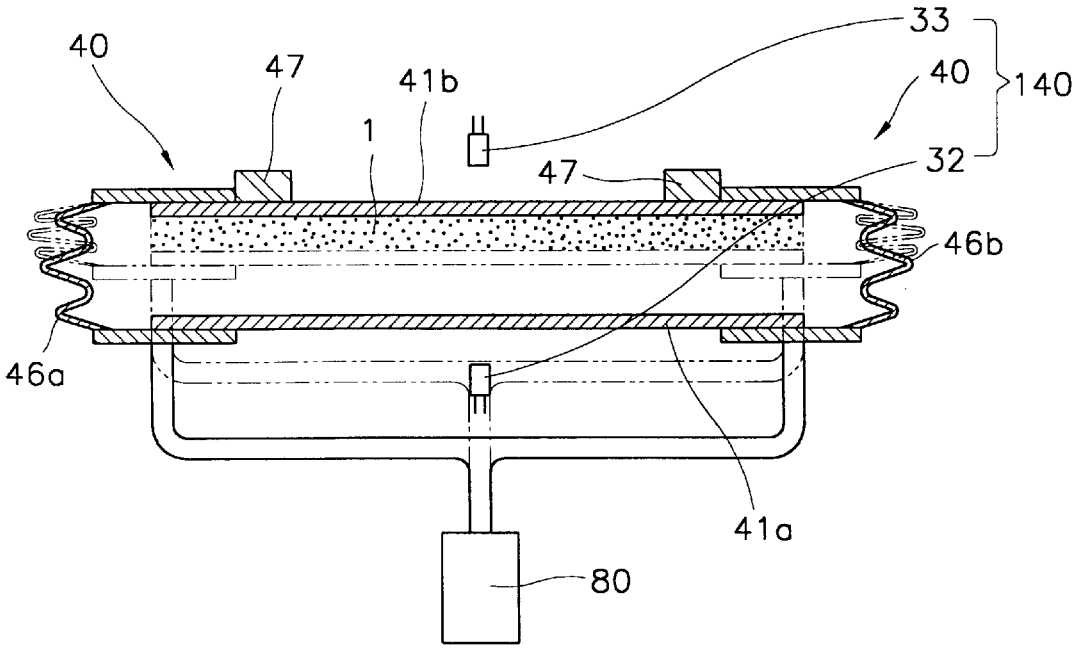
FIG. 6 is a sectional view illustrating the concentration measuring device shown in FIG. 5.

FIGS. 5 and 6 show a perspective view and a sectional view, respectively, of a second embodiment of the concentration measuring device employed in the printer of FIG. 2, where like elements are denoted by like reference numerals. As shown in FIGS. 5 and 6, each of the concentration measuring devices 140 includes a variable thickness body 40 installed between one of the mixing containers 21*a* through 21*d* and a corresponding one of the development devices 17*a* through 17*d* for changing the thickness of a developer liquid passage for light to transmit, a light emitting device 32 installed a predetermined distance from one side of the variable thickness body 40 for emitting light, and a light detector 33 installed a predetermined distance from the other side of the variable thickness body 40 for detecting the light from the light emitting device 32 and measuring the concentration of developer liquid 1 according to the amount of received light.

The variable thickness body 40 includes a pair of transparent substrates 41*a* and 41*b* made of transparent material for forming a passage of the developer liquid 1 therebetween, a pair of sealing members 46*a* and 46*b* installed at both edges of the transparent substrates 41*a* and 41*b* for preventing the developer liquid 1 contained between the transparent substrates 41*a* and 41*b* from leaking, and a driver 45 installed with respect to the transparent substrate 41*a* for changing the thickness of a developer liquid passage by changing the distance between the transparent substrates 41*a* and 41*b*. In addition, supporting members 47 are installed at two sides of the transparent substrate 41*b* by the side of the sealing member 46*b* and by the side of the sealing member 46*a* to fix the transparent substrate 41*b*. The supporting members 47 are fixed at predetermined positions in the printer.

The driver 45 is composed of a rod 45*a* installed on the transparent substrate 41*a*, and a solenoid 45*b* for pushing and pulling the rod 45*a*. The rod 45*a* has a structure to support two sides of the transparent substrate 41*a* simultaneously. In this embodiment, though the driver 45 is installed on one transparent substrate 41*a*, another driver may be installed on the other transparent substrate 41*b*. It is preferable that the sealing members 46*a* and 46*b* are in the shape of a bellows having pleats to allow expansion and contraction.

Now, the operation of the concentration measuring device having the above structure will be described.

During normal operation of a printer, the developer liquids of the mixing containers 21*a* through 21*d* are supplied to the respective development devices 17*a* through 17*d* via the respective variable thickness bodies 40. In this state, the transparent substrates 41*a* and 41*b* are parallel to each other to form a normal passage, and the developer liquid passes freely through the passage.

When the concentration of the developer liquid 1 is to be measured, the thickness of the variable thickness body 40 must be reduced to make the thickness of the developer liquid 1 thin. In order to make the thickness of the variable thickness body 40 thin, the rod 45*a* of the driver 45 pushes the edges of the transparent substrate 41*a* in parallel toward the other transparent substrate 41*b* to narrow the space between the two transparent substrates 41*a* and 41*b*. The sealing members 46*a* and 46*b* seal the edges of the transparent substrates 41*a* and 41*b*, and prevent the developer liquid 1 contained in the transparent substrates 41*a* and 41*b* from leaking. At this stage, the light emitting device 32 emits light toward the developer liquid 1, and the light detector 33 detects the light transmitted through the developer liquid 1, and the concentration of the developer liquid is determined by measuring the amount of transmitted light.

As described above, the concentration measuring device of an electrographic printer according to the present invention can measure the concentrations of yellow, cyan and magenta developer liquids by changing the thickness of a variable thickness body, and particularly, the device is very advantageous for measuring the concentration of black developer liquid through which light is difficult to transmit.

It is contemplated that numerous modifications may be made to the concentration measuring device for an electrographic printer of the present invention without departing from the spirit and scope of the invention as defined in the following claims.

What is claimed is:

1. A concentration measuring device, in an electrographic printer, for measuring the concentration of developer liquid supplied from a mixing container to a development device, said concentration measuring device comprising:

a variable thickness body installed between the mixing container and the development device for changing the thickness of a developer liquid passage for light to transmit;

a light emitting device installed a predetermined distance from one side of the variable thickness body for emitting light; and a light detector installed a predetermined distance from the other side of the variable thickness body for detecting the light from the light emitting device and measuring the concentration of the developer liquid according to the amount of received light.

2. The concentration measuring device as claimed in claim 1, wherein the variable thickness body includes:

a pair of transparent substrates made of transparent material for forming a passage of the developer liquid therebetween;

a spacing bar installed between first side edges of the transparent substrates for maintaining a space between the transparent substrates;

a driver installed at the other side of the transparent substrate for changing the thickness of the developer liquid passage by changing the distance between second side edges of the transparent substrates; and a pair of sealing members installed at both the first and the second side edges of the transparent substrates for preventing the developer liquid contained between the transparent substrates from leaking.

3. The concentration measuring device as claimed in claim 2, wherein the driver includes a rod which is installed on at least one of the transparent substrates, and a solenoid for pushing and pulling the rod.

4. The concentration measuring device as claimed in claim 2, wherein the sealing members have pleats to allow expansion and contraction.

5. The concentration measuring device as claimed in claim 1, wherein the variable thickness body includes:

a pair of transparent substrates made of transparent material for forming a passage of the developer liquid therebetween;

a pair of sealing members installed at both edges of the transparent substrates for preventing the developer liquid contained between the transparent substrates from leaking; and a driver installed with respect to at least one of the transparent substrates for changing the thickness of the developer liquid passage by changing the distance between the transparent substrates.

6. The concentration measuring device as claimed in claim 5, wherein the driver includes a rod which is installed on the at least one of the transparent substrates, and a solenoid for pushing and pulling the rod.

7. The concentration measuring device as claimed in claim 5, wherein the sealing members have pleats to allow expansion and contraction.

* * * * *